US005566686A

United States Patent [19]

Grossbach et al.

[11] Patent Number: 5,566,686

[45] Date of Patent: Oct. 22, 1996

[54] METHOD AND DEVICE FOR DETERMINING THE DENSITY OF A STREAM OF FIBROUS MATERIAL ON A CIGARETTE MANUFACTURING MACHINE

[75] Inventors: Rudolf Grossbach, Mainz; Peter Huber, Frankfurt A.M.; Ernst-Guenter Lierke, Schwalbach/TS; Michael Fiedler, Hofheim; Rainer Weiss, Hattersheim, all of Germany; Armando Neri, Bologna, Italy; Giancarlo Santin, San Lazzaro Di Savena, Italy; Giovanni Squarzoni, Argelato, Italy

[73] Assignee: G.D. Societa 'Per Azioni, Bologna, Italy

[21] Appl. No.: 349,070

[22] Filed: Dec. 2, 1994

[30] Foreign Application Priority Data

Dec. 3, 1993 [IT] Italy ..... B093A0486

[51] Int. Cl.[6] ..... A24C 5/14

[52] U.S. Cl. ..... 131/84.4; 131/905

[58] Field of Search ..... 131/84.1, 84.4, 131/905, 906, 909, 910, 280

[56] References Cited

U.S. PATENT DOCUMENTS

| | | | |
|---|---|---|---|
| 1,878,109 | 9/1932 | Clark | 131/910 X |
| 2,535,027 | 12/1950 | Anderson | 131/910 X |
| 4,045,657 | 8/1977 | Falke | 131/910 X |
| 4,942,363 | 7/1990 | Lowitz | 131/905 X |

*Primary Examiner*—Jennifer Bahr
*Attorney, Agent, or Firm*—Ladas & Parry

[57] ABSTRACT

To determine the density of a stream of fibrous material on a cigarette manufacturing machine, two different measurements are performed, the first of which is capacitive and supplies a first signal as a function of the density of the dry component and of the density of the liquid in the stream of fibrous material, and the second of which is optical and supplies a second signal indicating the density of the dry component; the second signal is combined with the first signal to obtain a third signal indicating the density of the liquid in the stream of fibrous material; and, from the third and second signals, a fourth signal is obtained indicating the density of the stream of fibrous material as the sum of the density of the dry component and of the liquid in the stream of fibrous material.

19 Claims, 4 Drawing Sheets

METHOD AND DEVICE FOR DETERMINING THE DENSITY OF A STREAM OF FIBROUS MATERIAL ON A CIGARETTE MANUFACTURING MACHINE

BACKGROUND OF THE INVENTION

The present invention relates to a method and device for determining the density of a stream of fibrous material on a cigarette manufacturing machine.

In the following description, reference is made purely by way of example to a cigarette manufacturing machine and to determination of the tobacco density of a continuous cigarette rod.

As is known, on cigarette manufacturing machines, a suction conveyor belt draws the tobacco from a tank and deposits it on to a continuous strip of paper; the longitudinal edges of the paper strip are then folded one on top of the other about the tobacco; and the continuous cigarette rod so formed is fed to a cutting station where it is cut into single or double cigarettes.

The tobacco is normally supplied in such a manner as to be distributed unevenly inside the cigarette, and more specifically in such a manner as to be denser at the two ends than in the center, to prevent tobacco fallout and detachment of the filter from the cigarette, and at the same time ensure correct ventilation of the intermediate portion of the cigarette. This is achieved by supplying a greater quantity of tobacco at the ends of the cigarette as compared with the center, for which purpose, a rotary shaving device is provided along the path of the tobacco on the conveyor, for shaving it into the contour corresponding to the required density. The shaving device is both height adjustable for controlling the mean quantity of tobacco in each cigarette (mean density or weight), and time adjustable for obtaining a maximum quantity of tobacco at the point at which the continuous cigarette rod is cut (adjacent ends of two cigarettes); which adjustment is made according to the discrepancy between the desired distribution of the tobacco and the actual distribution determined on the cigarette rod upstream from the cutting station.

Various solutions currently exist for determining the actual distribution of the tobacco, most of which feature a beta-ray sensor comprising a radioactive source and a beta ray detector located on either side of the cigarette rod, along the path of the rod between the forming and cutting stations. The radioactive source typically comprises a strontium (Sr90) pellet, and is housed inside a shielded container with a hole facing the cigarette rod; and the detector comprises an ionization chamber and an electrometer for measuring the energy of the incoming radiation. On the basis of fluctuations in the incoming radiation, an electronic system connected to the detector determines the variation in the density of the tobacco and controls the shaving knife accordingly.

Though precise and reliable, the above solution creates numerous problems, mainly due to the use of harmful radiation which, on the one hand, requires special care and procedures on the part of the operators, and, on the other, poses problems for disposing of the depleted pellets. All these problems are further compounded by the energy of the emitted radiation being correlated to the traveling speed of the cigarette rod, and by the current tendency to produce increasingly fast-operating machines therefore requiring greater amounts of energy. As a result, alternative solutions have been devised featuring different types of sensors, the efficiency of which, however, is impaired by the sensors being sensitive to different parameters such as the humidity, colour and more or less fibrous structure of the tobacco.

SUMMARY OF THE INVENTION

It is an object of the present invention to provide an accurate, reliable method and device for determining the mass of tobacco in the stream of material, without using sensors involving harmful radiation.

According to the present invention, there is provided a method of determining the density of a stream of fibrous material on a cigarette manufacturing machine, said stream of fibrous material comprising a dry component and a liquid in varying unknown proportions; characterized in that it comprises the steps of:

effecting a first capacitive measurement for obtaining a first signal as a function of the density of the dry component and of the density of the liquid in said stream of fibrous material;

effecting a second optical measurement for obtaining a second signal correlated to the density of the dry component in said stream of fibrous material; and generating, on the basis of said first and second signals, a third signal indicating the density of said stream of fibrous material.

According to the present invention., there is also provided a device for determining the density of a stream of fibrous material on a cigarette manufacturing machine, said stream of fibrous material comprising a dry component and a liquid in varying unknown proportions; characterized in that it comprises:

a first capacitive sensor for generating a first signal as a function of the density of the dry component and of the density of the liquid in said stream of fibrous material;

a second optical sensor for generating a second signal correlated to the density of the dry component in said stream of fibrous material; and first generating means supplied with said first and second signals and generating a third signal indicating the density of said stream of fibrous material.

BRIEF DESCRIPTION OF TEE DRAWINGS

A number of non-limiting embodiments of the present invention will be described by way of example with reference to the accompanying drawings, in which.

DETAILED DESCRIPTION OF THE INVENTION

Figure 1:
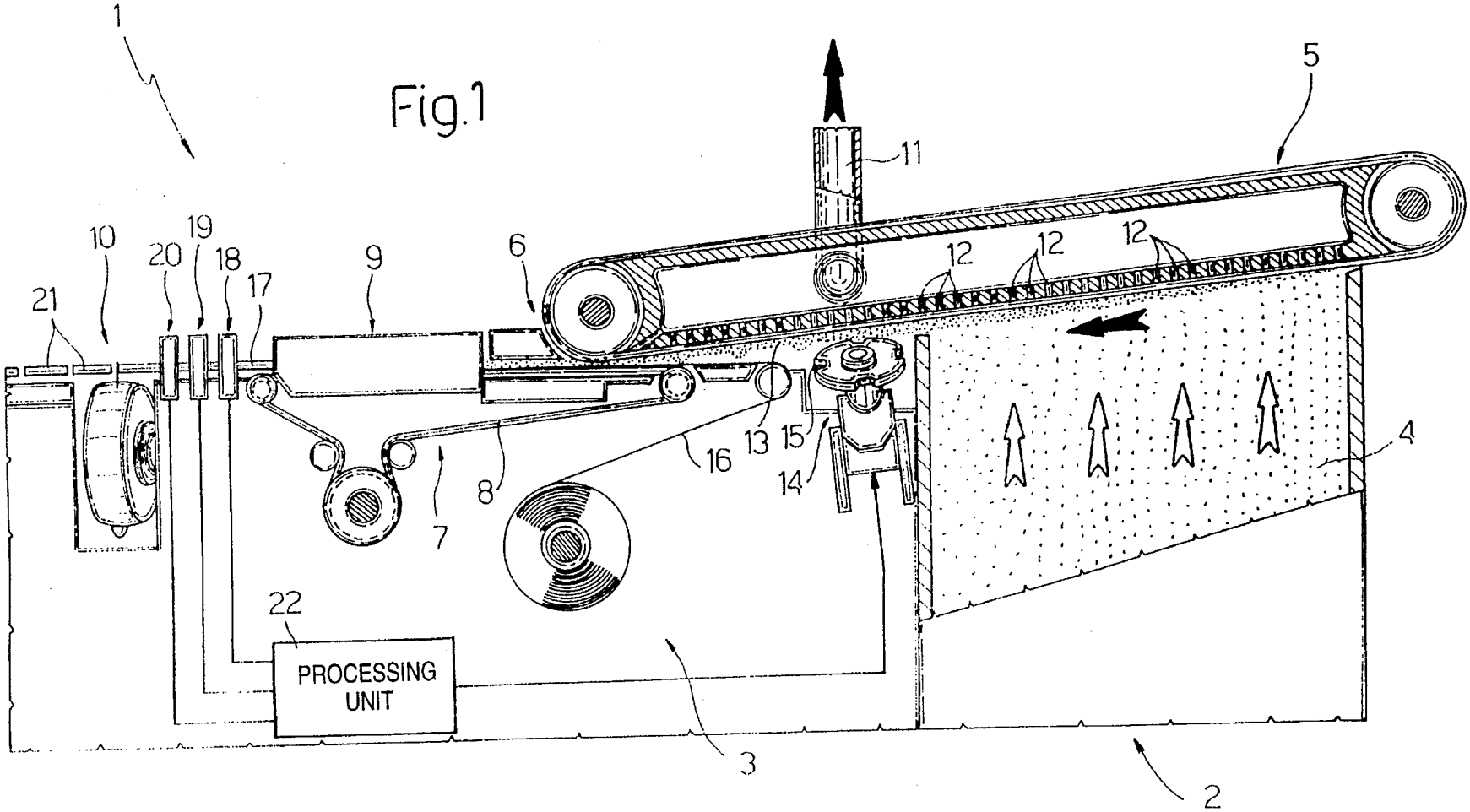
FIG. 1 shows a schematic view of a cigarette manufacturing machine featuring a first embodiment of the device according to the present invention.

Number 1 in FIG. 1 indicates a cigarette manufacturing machine comprising a tobacco feed unit 2 (shown only partially) and a paper feed unit 3. Of tobacco feed unit 2 are shown only an upflow duct 4, and a conveyor 5 extending between duct 4 and a tobacco unloading station 6; and paper feed unit 3 comprises a conveyor 7 with a belt 8, a forming beam 9, and a cutting station 10. In known manner, conveyor 5—which presents a vacuum inside generated by conduit 11, and holes 12 along its bottom branch—draws the tobacco from duct 4 to form a continuous layer 13; and along the path of the tobacco, beneath conveyor 5, a rotary shaving device 14 with recesses 15 removes the surplus tobacco in known, differential manner to achieve a predetermined contour of continuous layer 13.

At unloading station 6, the shaved tobacco layer is deposited on to a continuous strip of paper 16, the two longitudinal edges of which are folded one on top of the other and gummed on forming beam 9 to form a continuous cigarette rod 17. Along the path of rod 17 downstream from forming beam 9, there are provided three sensors 18, 19, 20 forming part of the device according to the invention for determining the distribution of the tobacco inside rod 17 which is then fed through cutting station 10 where it is cut into cigarette portions 21. Though not shown in FIG. 1, the components of machine 1, with the exception of duct 4, are duplicated to form two side by side, parallel-operating lines.

Sensors 18–20 are connected to a processing unit 22 for processing the signals generated by sensors 18–20 and determining the actual distribution of the tobacco in rod 17, and which, depending on the extent to which this differs from the predetermined distribution, adjusts the height and timing of shaving device/s 14. Processing unit 22 also provides for other functions such as calculating statistics and discrepancy percentages, determining the structural characteristics of the tobacco (e.g. relative humidity), etc..

Figure 2:
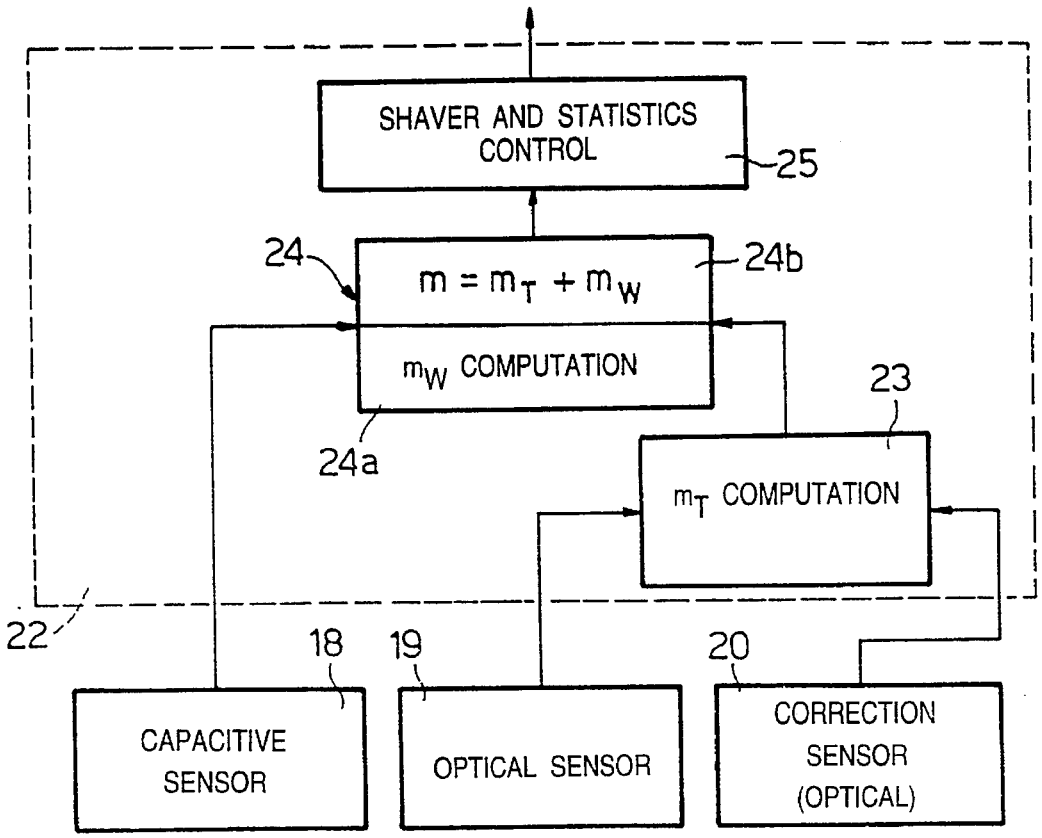
FIG. 2 shows a block diagram of the device according to the present invention.

The signals supplied by sensors 18–20 are combined for accurately determining the actual distribution of the tobacco inside rod 17, as shown in FIG. 2. In more detail, sensor 18 is a capacitive sensor, the capacitance of which depends on both the dry tobacco and water content of the cigarette rod, and the appropriately processed output signal DC of which therefore varies according to the equation:

$$DC=K1\ mT\ (K2+mW/mT) \quad (1)$$

wherein K1 and K2 are two constants depending in known manner on the sensor, tobacco and water characteristics; and mT is the mass of dry tobacco and mW the mass of water in the cigarette rod.

Figure 3:
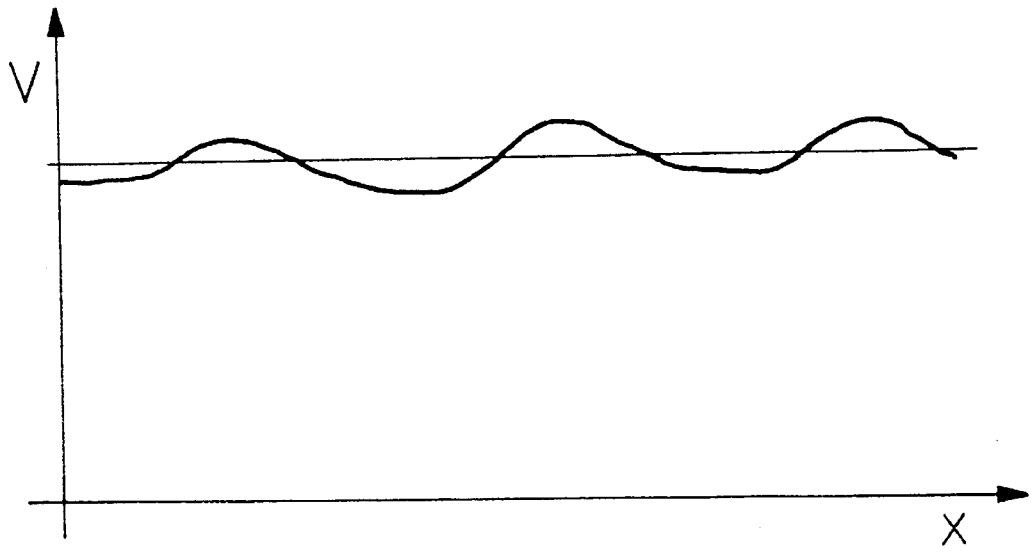
FIG. 3 shows a laboratory test diagram of the tobacco contour determined by the capacitive sensor.

Capacitive sensor 18 therefore supplies a voltage output signal (FIG. 3) accurately reproducing the mass (and hence the density, defined as the ratio between mass and a given volume) of the tobacco ,along the cigarette rod, but which is highly sensitive to the water content of the rod. Due to the differing dielectric properties involved, the capacitive sensor in fact is far more sensitive to water than to the dry tobacco. Moreover, as the output signal of the capacitive sensor is not directly related to the total density of the rod, i.e. to the total density of the two components, the capacitive sensor alone is incapable of measuring the density of the rod or even distinguishing between the contribution made by the dry tobacco and the water.

To calculate the actual mass of material (dry tobacco and water) in the rod, the mass (density) of the dry tobacco is measured separately to distinguish the dry tobacco contribution from that of the water in the output signal of capacitive sensor 18 and subsequently calculate the total density (mass). As optical sensors with a wavelength within the infrared range are insensitive to humidity in the material under examination, the second measurement is made using second infrared optical sensor 19.

The output signal DI of the optical sensor depends on the mass of dry material (tobacco) according to the equation:

$$DI=K3\ exp\ (-K4\ mT) \quad (2)$$

wherein K3 and K4 are constants depending in known manner on the sensor and the dry material (tobacco). Consequently, by logarithmically amplifying the output signal, it is possible to obtain a signal SI directly proportional to the mass of dry tobacco, according to the equation:

$$SI=K5\ mT \quad (3)$$

wherein K5 is a constant again depending on the sensor and the material; and mT again indicates the mass of dry tobacco.

As optical sensor 19 on its own is also incapable of supplying the total density of rod 17, by entering into (1) the value of mT calculated in (3), it is possible to determine the mass of water and, by adding this to the mass of dry tobacco, the total mass. The mass of dry tobacco and water may be calculated with reference to very small portions of the rod (practically the volume "viewed" by the sensors) for achieving a substantially point-by-point density pattern,, or with reference to rod portions of predetermined length for obtaining the mean dry tobacco and water mass value over said portions. In the latter case, it is possible to obtain the mean total density value, while the variation in the total density of the rod is given by the capacitive signal.

In most cases, however, the accuracy of infrared optical sensors is impaired by constant K5 in equation (3) also depending on the colour of the material, so that the output signal of the sensor also depends on variations in the colour of the material (in this case, tobacco) under examination.

To solve this problem, especially in the case of tobacco of widely differing colour, a third sensor 20 is provided to eliminate the colour effect from the output signal of optical sensor 19. According to a preferred embodiment of the invention, this is done using a further optical sensor operating at a different frequency from second optical sensor 19. More specifically, second optical sensor 19 may operate at wavelengths of 800 to 850 nm, and third optical sensor 20 at a higher wavelength, so that the combined signals of sensors 19 and 20 (typically the ratio of the two signals) give a signal indicating the colour itself and usable for calibrating or correcting second sensor 19, or at any rate are insensitive to the colour of the tobacco.

The correction signal generated by means of third sensor 20 may be calculated only occasionally on predetermined samples of the cigarette rod, and the correction data used between one update and the next; or it may be calculated continuously, together with the signals supplied by the first and second sensors, for continuous, nondiscrete correction.

The output signals of sensors 19 and 20 are supplied to a dry weight computing unit 23 which, as explained above, provides for calculating the mass (density) of the dry tobacco from the output signal of sensor 19 which is corrected on the basis of the output signal of sensor 20 to eliminate the colour effect. The output signal of unit 23, together with the output signal of first sensor 18, is then supplied to a unit 24 for determining the density of the water and the total density of the material in rod 17. As already stated, unit 24 is divisible theoretically into two sections: a section **24*a* for calculating the mass (density) of the water in the rod material; and a section 24*b* for calculating the total mass (density) of the rod material by adding the mass (density) of the dry tobacco and water in the rod. The output signal of unit 24 is then supplied to a unit 25 which, on the basis of the required distribution of material in rod 17, generates control signals in known manner for adjusting the height and timing of shaving device 14 (FIG. 1**).

Unit 25 also provides for statistical processing, and for determining other information on the basis of the sensor signals, such as humidity on the basis of the ratio between the water and dry tobacco mass (mW/mT). Units 23–25 conveniently all form part of processing unit 22.

Figure 4:
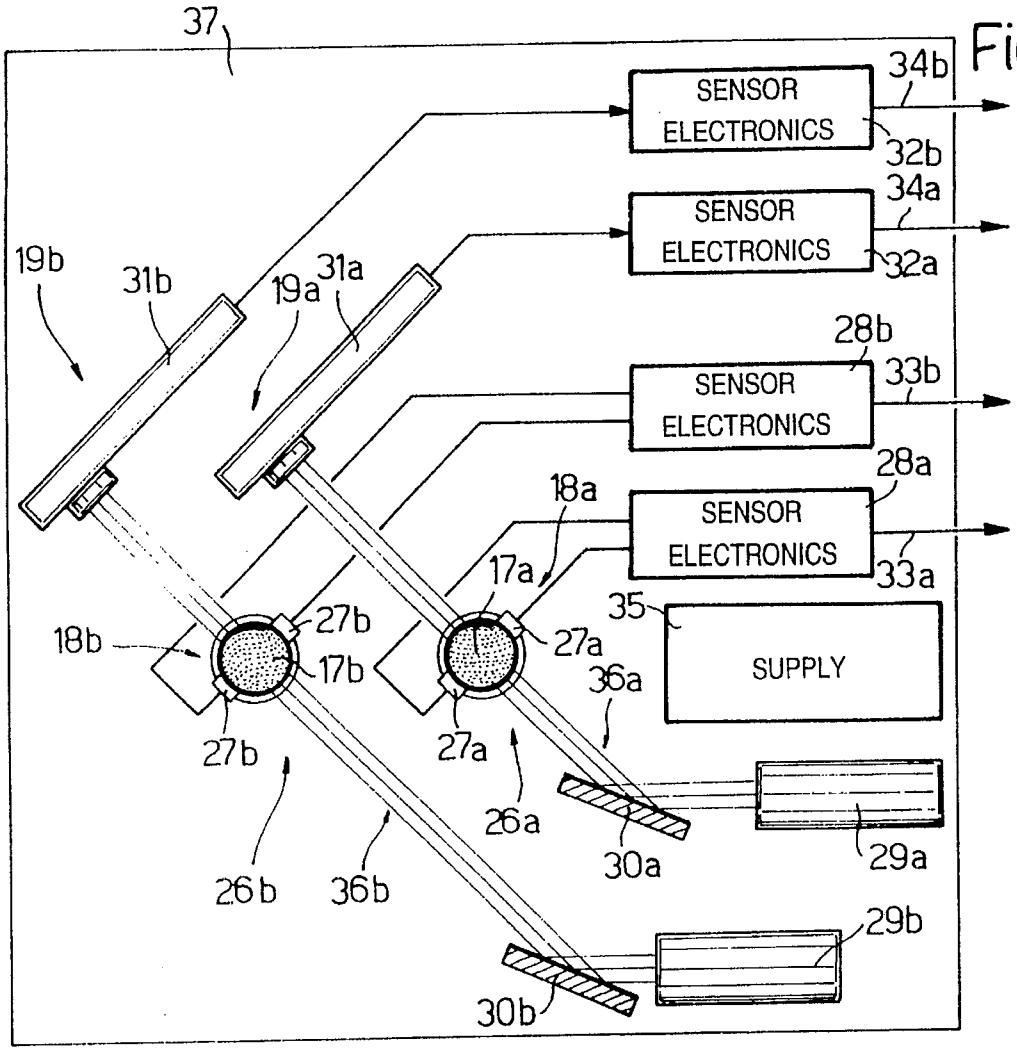
FIG. 4 shows a machine cross section illustrating a detail of the device according to the invention.

FIG. 4 shows a further arrangement of sensors 18 and 19, which, as opposed to being arranged one after the other along the path of rod 17 as in FIG. 1, are located at the same cross section of the rod. FIG. 4 shows the two lines 26*a*, 26*b* of the machine, the cross sections of the two rods, here indicated 17*a*, 17*b*, and the respective pairs of sensors 18*a*, 19*a* and 18*b*, 19*b*.

Each capacitive sensor 18*a*, 18*b* comprises a respective pair of electrodes 27*a*, 27*b*, and a respective electronic signal processing and control circuit 28*a*, 28*b*; and each optical sensor 19*a*, 19*b* comprises a respective infrared source 29*a*, 29*b*, a respective mirror 30*a*, 30*b*, a respective infrared receiver 31*a*, 31*b*, and a respective electronic signal processing and control circuit 32*a*, 32*b*. The respective output signals of electronic circuits 28*a*, 28*b*, 32*a*, 32*b* are supplied to processing unit 22 (FIG. 1) over respective lines 33*a*, 33*b*, 34*a*, 34*b*; and sensors 18*a*, 19*a* and 18*b*, 19*b* are conveniently assigned a single supply unit 35. Also shown schematically in FIG. 4 are a housing 37, and the infrared rays 36*a*, 36*b* through rods 17*a*, 17*b*.

If third sensor 20 is optical, all three sensors 18, 19 and 20 may be located at the same cross section of rod 17, in which case, to avoid impairing the sensitivity of the sensors, optical sensors 19, 20 are preferably so located about rod 17 that the infrared rays do not intercept the joined longitudinal edges of the paper. Alternatively, optical sensors 19 and 20 are located at the same cross section, and capacitive sensor 18 is located up- or downstream from the optical sensors, at a different cross section, and the respective signals are correlated by processing unit 22 (FIG. 1).

According to a further embodiment, as opposed to operating by transmission, at least one of the two optical sensors, typically optical sensor 20, operates by reflection, and the output signal is obtained from the ray preferably reflected by the continuous layer of tobacco. This solution is shown in FIG. 5, which shows, schematically, a section of machine 1 (FIG. 1) immediately downstream from unloading station 6 and upstream from forming beam 9.

Figure 5:
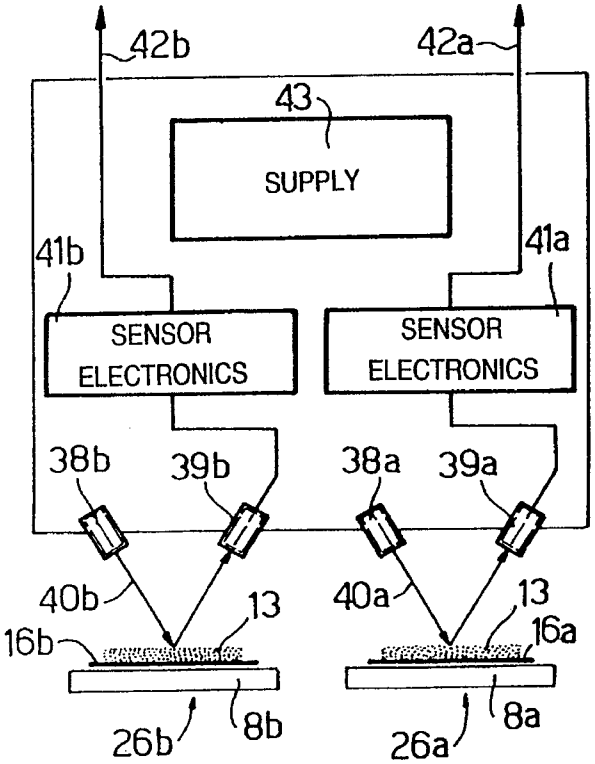
FIG. 5 shows a machine cross section illustrating a variation of a detail of the device according to the invention.

FIG. 5 also shows the two lines 26*a*, 26*b*, each presenting a respective light source 38*a*, 38*b*; a respective receiver 39*a*, 39*b* (along the reflection path of rays 40*a*, 40*b*); a respective electronic control circuit 41*a*, 41*b* connected to processing unit 22 (FIG. 1) over a respective line 42*a*, 42*b*; and a common supply unit 43.

According to a further embodiment, provision is made for a fourth optical sensor (not shown) operating with third sensor 20 but at a different frequency, so that the combined output signals of the third and fourth sensors supply a precise tobacco colour signal by which to correct the signal of second sensor 19. In which case, the fourth sensor should operate in the same way as sensor 20 and preferably be located very close to it.

Alternatively, as opposed to third sensor 20, a chromometer or other commercial device may be provided for directly determining the tobacco colour and supplying a signal by which to correct the second signal supplied by sensor 19.

Figure 6:
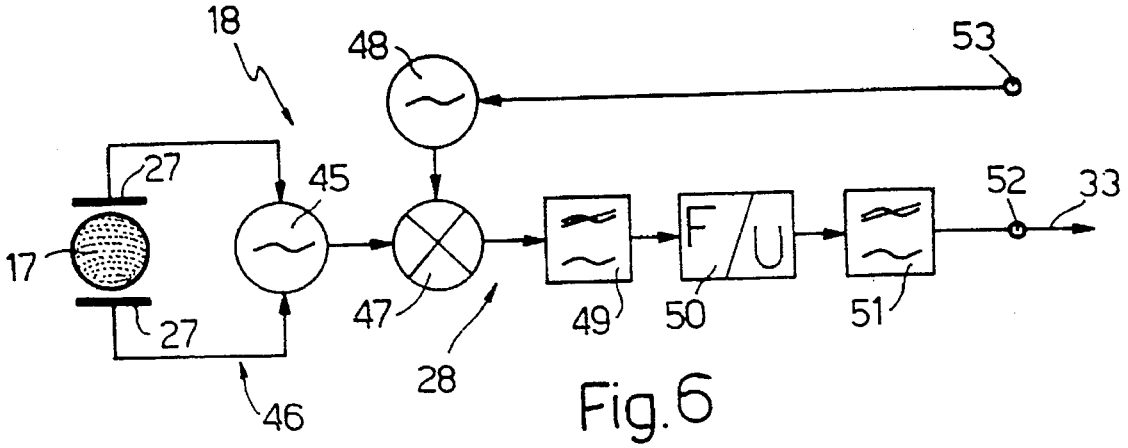
FIGS. 6 and 7 show circuit diagrams of the sensors featured in the device according to the invention.

FIG. 6 shows an electric diagram of capacitive sensor 18, including electronic signal processing and control circuit 28. In FIG. 6, the two electrodes 27 on either side of continuous cigarette rod 17 constitute, together with a circuit 45, a high-frequency oscillating circuit 46, the frequency of the oscillating output signal of which varies alongside a variation in the capacitance of the electrode 27/rod 17 group and, as stated, is correlated to the mass of tobacco and the mass of water in the material traveling between the two electrodes. In a multiplier 47, the output signal of oscillating circuit 46 is multiplied by a reference signal generated by an oscillator 48, to give an oscillating signal with a frequency equal to the difference between the frequencies of the output signal of oscillating circuit 46 and the reference signal. The output signal of multiplier 47 is filtered in a low-pass filter 49 and converted into a voltage signal by a frequency/voltage converter 50, the output signal of which is then filtered in a low-pass filter 51 and supplied to output 52 connected over line 33 to processing unit 22 (FIG. 1). An input 53 is connected to reference oscillator 48, for adjusting and calibrating the reference oscillating signal.

Figure 7:
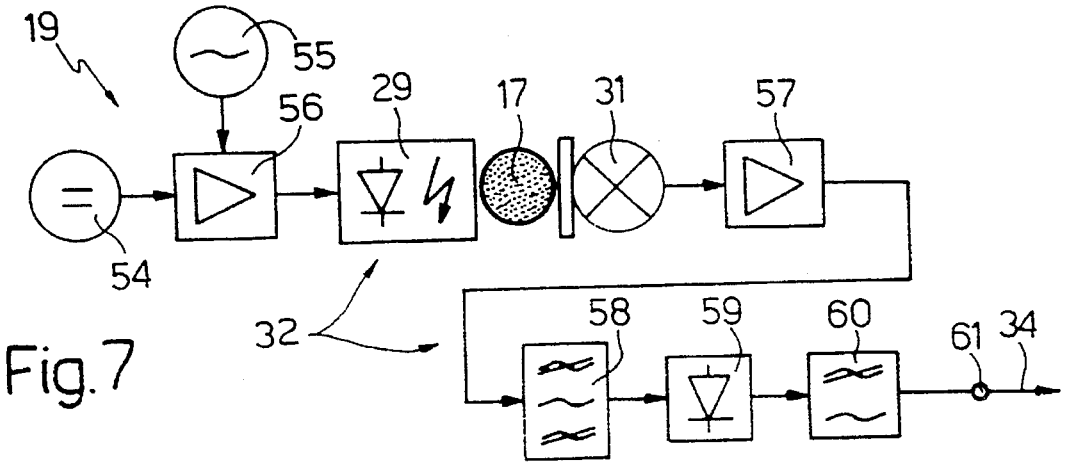

FIG. 7 shows an electric diagram of second optical sensor 19 (and third sensor 20 if optical), including electronic signal processing and control circuit 32. Circuit 32 comprises a generator 54 for biasing infrared source 29, and a modulating generator 55, the outputs of which are connected to an infrared source drive element 56 in turn connected to source 29. The output of infrared receiver 31 is connected to a transimpedance amplifier 57 cascade-connected to a band-pass filter 58, a rectifier 59, and a low-pass filter 60 whose output defines the output 61 of electronic circuit 32 and is connected over line 34 to processing unit 22.

In actual use, sensors 18, 19 and 20 generate three separate signals correlated to the characteristics of the continuous cigarette rod, and which are sampled with reference to successive sections of the rod and processed as described for accurately and reliably determining the total mass (density) of the tobacco instant by instant; which density measurement is used for correcting the distance between the shaving device and conveyor belt 5 and so varying the mean mass (density) of the tobacco, and for briefly slowing down or accelerating rotation of the shaving device (timing adjustment) to adjust the thickest tobacco point (the ends of the finished cigarettes).

The cooperation of two sensors—one capacitive and the other optical—is therefore essential for controlling the shaving device; and the use of at least a third (optical) calibration sensor provides for even more accurate detection, and hence control, by making it independent of external influences (humidity, colour and structure of the tobacco). The processed signals also provide for obtaining further information regarding the characteristics of the tobacco, such as colour and humidity.

By eliminating the use of harmful radiation sources, the device according to the present invention therefore provides for greatly simplifying handling, maintenance and part replacement procedures.

What is claimed is:

1. A method of determining the density of a stream of fibrous material (17) on a cigarette manufacturing machine (1), said stream of fibrous material (17) comprising a dry component and a liquid in varying unknown proportions; said method comprising the steps of:

effecting a first capacitive measurement for obtaining a first signal indicating a quantity which may be expressed as a function of the density of the dry component and of the density of the liquid in said stream of fibrous material;

effecting a second optical measurement for obtaining a second signal correlated to the density of the dry component in said stream of fibrous material; and generating, on the basis of said first and second signals, a third signal indicating the density of said stream of fibrous material.

2. A method as claimed in claim 1, characterized in that said step of generating a third signal comprises the steps of generating, on the basis of said first and second signals, a fourth signal indicating the density of the liquid in said stream of fibrous material; and adding said second signal to said fourth signal.

3. A method as claimed in claim 1 characterized in that it comprises the step of calculating the mean value of said second signal over a portion of said stream of fibrous material; and said step of generating a third signal comprises the step of determining the mean density of said stream of fibrous material on the basis of said first signal and said mean value of said second signal.

4. A method as claimed in claim 1, wherein said second signal is dependent on the density and at least one further characteristic of the dry component of said stream of fibrous material; characterized in that it comprises the steps of effecting a third measurement, independent of said first and second measurements, to obtain a fifth signal as a function of said further characteristic of the dry component of said stream of fibrous material; and correcting said second signal on the basis of said fifth signal to obtain a sixth signal independent of said further characteristic; and in that said step of generating a third signal comprises the step of determining the density of said stream of fibrous material on the basis of said sixth and first signals.

5. A method as claimed in claim 4, characterized in that said step of effecting a third measurement comprises the steps of optically measuring said density of said stream of fibrous material at a different frequency from said second measurement, to obtain said fifth signal; and calculating the ratio between said second and fifth signals.

6. A method as claimed in claim 4, characterized in that said step of effecting a third measurement comprises a reflection optical measurement of a quantity correlated to the colour of the dry component of said stream of fibrous material.

7. A device for determining the density of a stream of fibrous material (17) on a cigarette manufacturing machine (1), said stream of fibrous material (17) comprising a dry component and a liquid in varying unknown proportions; said device comprising:

a first capacitive sensor (18) for generating a first signal indicating a quantity which may be expressed as a function of the density of the dry component and of the density of the liquid in said stream of fibrous material;

a second optical sensor (19) for generating a second signal correlated to the density of the dry component in said stream of fibrous material; and first generating means (24) supplied with said first and second signals and generating a third signal indicating the density of said stream of fibrous material.

8. A device as claimed in claim 7, characterized in that said first generating means (24) comprises second generating means (24*a*) supplied with said first and second signals and generating a fourth signal indicating the density of the liquid in said stream of fibrous material; and adding means (24*b*) for adding said second signal to said fourth signal.

9. A device as claimed in claim 7, wherein said second signal is dependent on the density and at least one further characteristic of the dry component of said stream of fibrous material; characterized in that it comprises a third sensor (20) for generating a fifth signal as a function of said further characteristic of the dry component of said stream of fibrous material; and correcting means (23) for correcting said second signal on the basis of said fifth signal, to obtain a sixth signal independent of said further characteristic.

10. A device as claimed in claim 9, characterized in that said third sensor (20) is an optical sensor operating at a different frequency from said second sensor (19).

11. A device as claimed in claim 10, characterized in that said second (19) and third (20) sensors are infrared sensors.

12. A device as claimed in claim 9, characterized in that said correcting means (23) and said first generating means (24) form part of a central processing unit (22).

13. A device as claimed in claim 7, for a manufacturing machine (1) having a stream forming unit (9) and a cigarette cutting section (10); characterized in that said first and second sensors (18, 19) are located at the same cross section of said machine (1), are offset angularly in relation to each other, and are located between said stream forming unit (9) and said cigarette cutting section (10) of said machine.

14. A device as claimed in claim 9, for a manufacturing machine (1) having a stream forming unit (9) and a cigarette cutting section (10); characterized in that said third sensor (20) is located between said stream forming unit (9) and said cigarette cutting section (10) of said machine.

15. A device as claimed in claim 9, for a manufacturing machine (1) having a fibrous material supply unit (2) and a stream forming unit (9); characterized in that said third sensor (20) is located between said supply unit (2) and said stream forming unit (9).

16. A device as claimed in claim 9, characterized in that said third sensor (20) operates by transmission.

17. A device as claimed in claim 9, characterized in that said third sensor (20) operates by reflection.

18. A device as claimed in claim 7 characterized in that said first sensor (18) comprises an oscillating circuit (46) in turn comprising a pair of electrodes (27) along the path of said stream of fibrous material (17); a reference-frequency voltage generator (48); a multiplier (47) connected to said oscillating circuit (46) and to said reference-frequency voltage generator (48); and a frequency/voltage converter (50) connected to said multiplier (47) and generating a voltage signal correlated to the density of said stream of fibrous material.

19. A device as claimed in claim 7, characterized in that at least said second sensor (19) comprises an infrared-light emitter (29); an infrared detector (31); and amplifying (57), filtering (58, 69) and rectifying (59) means connected to said infrared detector (31).

* * * * *